United States Patent [19]

Schurman

[11] 4,101,033

[45] Jul. 18, 1978

[54] MOLDED CASE FOR SUPPORTING AND ENCLOSING AN ARTICLE

[75] Inventor: Peter T. Schurman, Woodbridge, Conn.

[73] Assignee: The Plastic Forming Company, Inc., Woodbridge, Conn.

[21] Appl. No.: 804,504

[22] Filed: Jun. 8, 1977

[51] Int. Cl.[2] ..... B65D 85/30

[52] U.S. Cl. ..... 206/521; 150/0.5; 206/525; 220/4 R

[58] Field of Search ..... 206/521, 525, 527, 349, 206/573; 150/0.5; 220/4 R, 4 C

[56] References Cited

U.S. PATENT DOCUMENTS

| | | | |
|---|---|---|---|
| 1,157,008 | 10/1915 | Lang | 220/6 X |
| 2,250,710 | 7/1941 | Hutt | 206/573 |
| 3,198,321 | 8/1965 | Politano | 206/573 |
| 3,312,262 | 4/1967 | Hunter | 150/0.5 |
| 3,317,076 | 5/1967 | Enders | 206/349 X |
| 3,327,841 | 6/1967 | Schurman | 206/349 |
| 3,365,308 | 1/1968 | Janicke | 206/525 X |

*Primary Examiner*—Donald F. Norton

*Attorney, Agent, or Firm*—St. Onge, Mayers, Steward & Reens

[57] ABSTRACT

A molded carrying case for supporting and enclosing an article comprises a main body member having an interior wall shaped to generally conform to the article. At least one inwardly protruding structure is formed with this interior wall. A base member is formed with an upstanding interior wall, which complements the interior wall of the body member, and a floor recessed from the upstanding wall, shaped to receive the article. The base and body members are rigidly secured together by an interlocking rabbet and flange formation. The case is completed by a closure member that is hinged to the main body for movement between open and closed position. The closure member also has an interior wall formed with at least one inwardly projecting structure that extends from the upstanding base wall and complements the main body interior wall when in the closed position.

20 Claims, 9 Drawing Figures

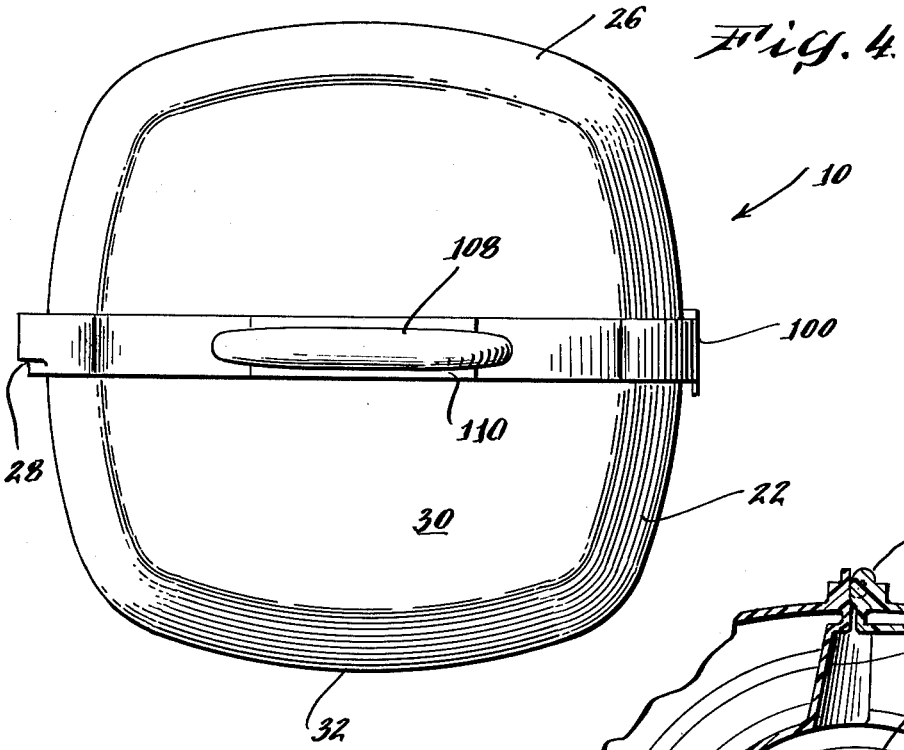
Fig. 4.
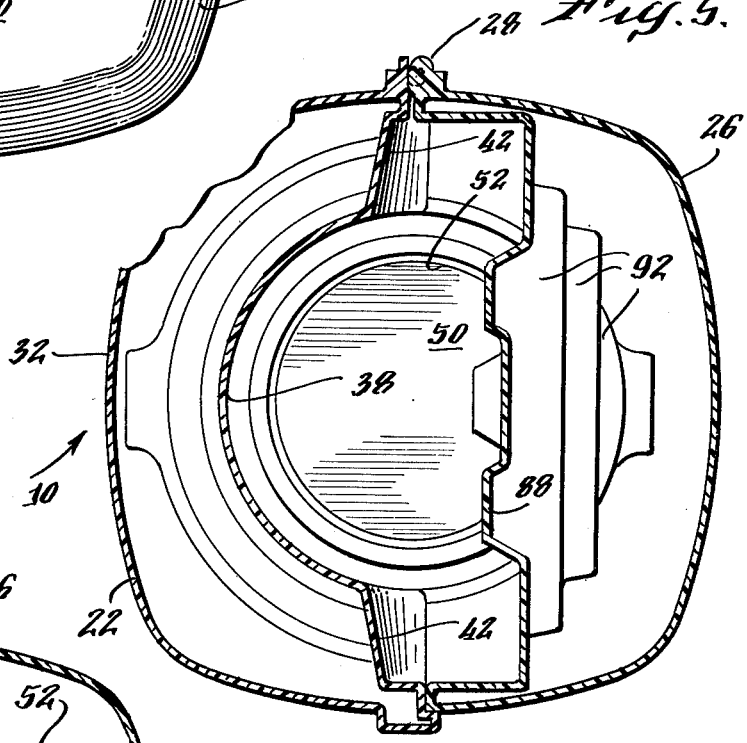
Fig. 5.
Fig. 6.
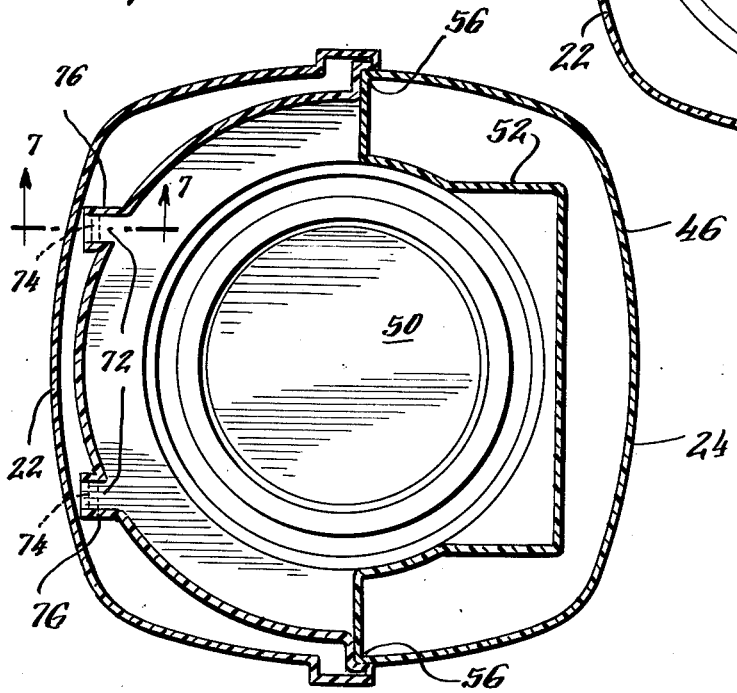
Fig. 7.
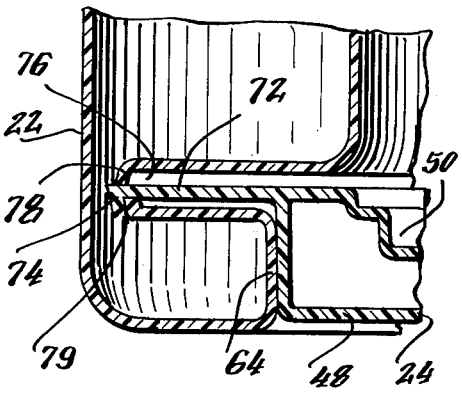

MOLDED CASE FOR SUPPORTING AND ENCLOSING AN ARTICLE

BACKGROUND OF THE INVENTION

1. Field of the Invention

The present invention relates to a molded carrying case for supporting and enclosing an article. For example, this case may be used to support and enclose a gas lantern, or a similar article of camping equipment. It may also be used to carry tools or any other objects or articles which are desirably protected during transportation and for storage.

The carrying case of the present invention permits any article which it stores to be easily placed therein or removed therefrom, yet securely retains the article in the case even when the case is open. The article carrying case of the present invention has particular utility for carrying and storing relatively tall articles in an upright position. For example, this case may be used to store gas lanterns which should be held in the position that prevents spilling of fuel.

2. Description of the Prior Art

Article and tool carrying cases have been devised in the past. In particular, cases for storing articles such as gas lanterns in an upright position that prevents spilling of fuel have been developed. Such cases typically were made of metal such as steel or aluminum. However, metal cases are characterized by relatively high weight and cost. Excess case weight is particularly objectionable when the case is used to store camping equipment since the case and its contents are often transported over large distances by the camper. Moreover, metal cases may be dented by impact which, if sufficient, may even damage the article which is being carried.

Molded plastic article carrying cases have also been proposed. However, molding problems have been encountered in forming extremely large cases. Moreover, certain configurations of carrying cases may not be easily molded because of the large number of reentrant formations therein. Such configurations require numerous molding steps if the number of component pieces of the case is to be minimized. However, even if a case design has relatively few parts, difficulties still arises when blow molding techniques are used. In particular, a double walled parison may be stretched excessively in various areas of the molding rendering those areas unacceptably weak. Accordingly, prior article carrying cases made either of the metal or molded plastic have certain drawbacks.

SUMMARY OF THE INVENTION

In a preferred embodiment, to be described below in detail the article carrying case of the present invention is blow molded. It comprises few parts, each of which is made by, at most, one molding step. The parts are assembled in non-demountable fashion to provide a case which stores and protects an article such as a gas lantern in an upright position. Moreover, the article is held in the case with reasonable security even when the case is open.

In its preferred embodiment, the molded case comprises a main body member that has an interior wall shaped to generally conform to a portion of the article. This interior wall has at least one inwardly projecting structure. The case is also comprised of a base member formed with an upstanding interior wall, which complements the interior wall of the main body member, and a floor recessed from the upstanding interior wall and shaped to receive the base of the article. A locking arrangement having engaging flanges and tabs is provided to non-demountably secure the base member to the main body member. A closure member, hinged to the main body member for movement between a closed and open position, is formed with an interior wall that generally extends from the base member upstanding wall and complements the main body interior wall when in the closed position. The closure member also has at least one inwardly projecting structure.

Because of the unique construction of the article carrying case of the present invention, including the locking arrangement between the base and body members, complex shapes having multiple reentrant portions can be made with a minimum of parts using a minimum number of molding operations. Yet, since the article carrying case is in fact molded, all of the advantages attendant to plastic cases may still be achieved. In particular, the case is light weight, sturdy, and provides more than adequate protection for the article which it carries.

Accordingly, it is an object of the present invention to provide a molded case for storing and enclosing an article which holds the article securely terein even when open and further which protects the article against damage. It is another object of the invention to provide a case having minimum number of components that may be made with a minimum number of molding steps. It is still a further object of the present invention to provide an assembly which once completed may not be easily demounted. That is, the components of the case of the present invention and, in particular, the main body and base members, may not be demounted without breaking.

Other objects, aspects, and advantages of the present invention will be pointed out in or be understood from the following detailed description provided below in conjunction with the accompanying drawings.

BRIEF DESCRIPTION OF THE DRAWINGS

FIG. 4 is a top plan view of the molded case.

FIG. 5 is a horizontal cross-sectional view taken through plane 5—5 in FIG. 3 looking downwardly.

FIG. 6 is a horizontal cross-sectional view taken through plane 6—6 in FIG. 3 looking downwardly and illustrating in detail the arrangement for securing the base member to the main body member.

FIG. 7 is an enlarged vertical cross-sectional view taken through plane 7—7 in FIG. 6 illustrating in greater detail this arrangement for securing the base member to the main body member.

DETAILED DESCRIPTION OF THE PREFERRED EMBODIMENT

Figure 9:
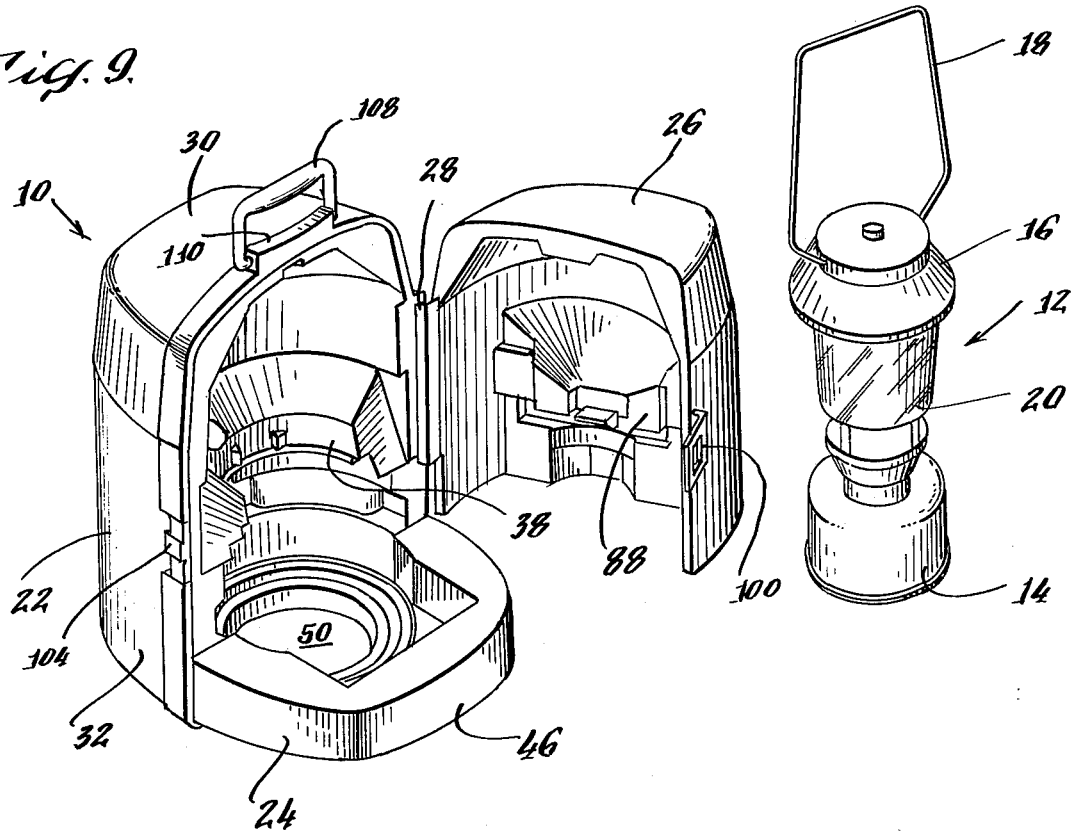
FIG. 9 is a perspective view of the case of the present invention shown in its open condition ready to receive an article such as a gas lantern.

Referring first to FIG. 9, the molded case of the present invention, generally indicated at 10, is formed to store and enclose an article such as a gas lantern, generally indicated at 12. The lantern 12 is formed with base or fuel reservoir 14, a top 16, a handle 18, and a globe 20. Because it is usually stored with some amount of residual fuel in its base, and because its globe is usually made of glass or other fragile heat-resistent and transparent material, the lantern should be supported in an upright position. If it is laid on its side, for example, fuel stored in its base or small amounts which remain after it is emptied may leak or spill. Accordingly, the case 12 of the present invention is designed to securely hold the lantern in such an upright position. Moreover, as will be described in greater detail below, the case is formed so that even when in open condition the lantern may not be easily dislodged from it.

It will be understood that for purposes of this description, the case of the preferred embodiment is formed to hold a lantern such as described above. However, the case, incorporating the features of the invention, may take any other general form for holding any desired article in a fixed position. And, the case may be designed to accept the article in a single position only.

Figures 1, 2, 3:
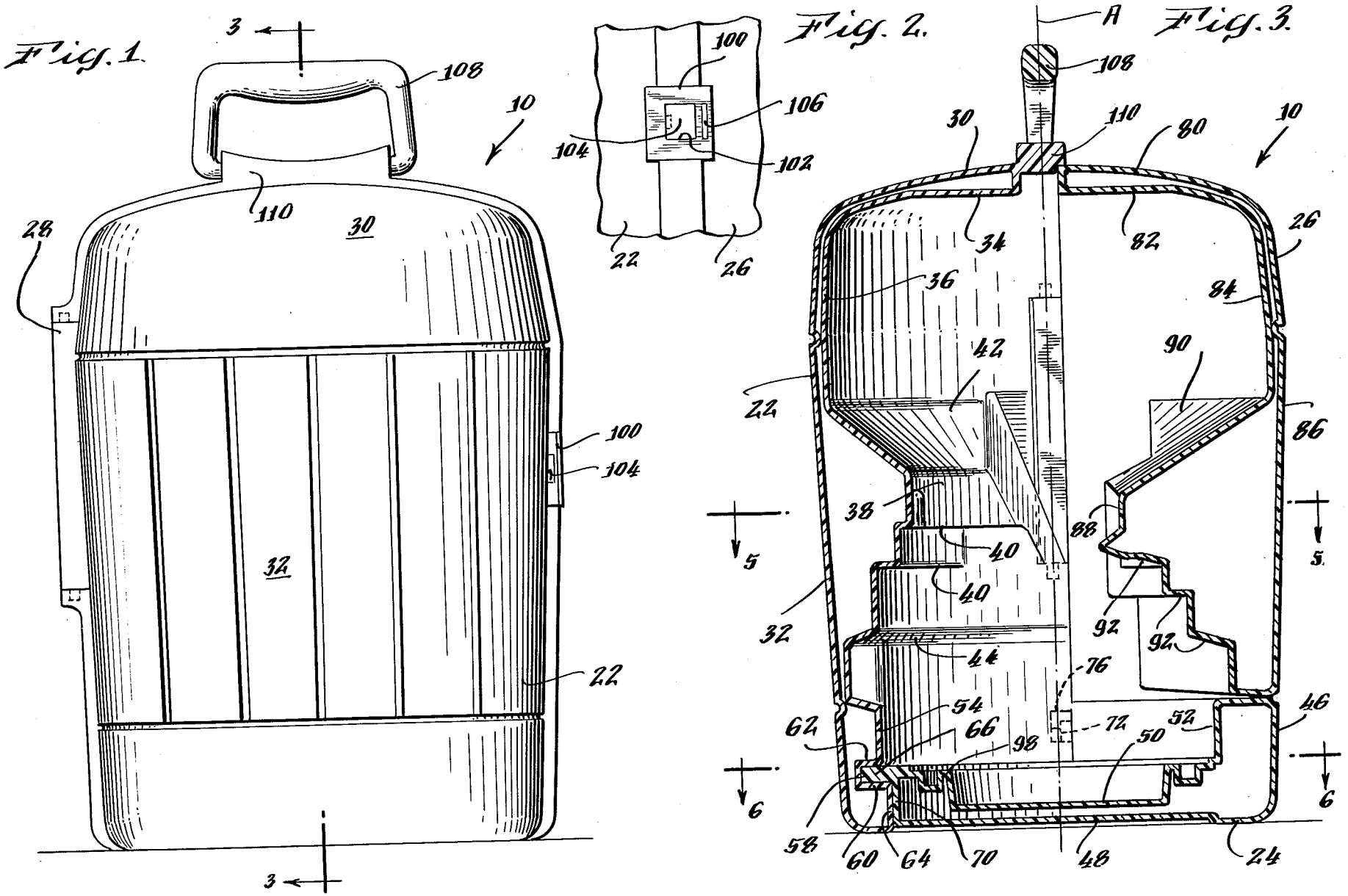
FIG. 1 is a rear elevational view of the molded case for supporting and enclosing an article made in accordance with the present invention.
FIG. 2 is an enlarged, partial elevational view of a latch member used to secure the closure member and the main body member in a closed condition.
FIG. 3 is a vertical cross-sectional view of the molded case taken through plane 3—3 in FIG. 1 looking toward the left.

As best been in FIGS. 1, 3 and 4, the case of the present invention comprises three large blow molded components. The first is a main body member 22 which is shown from the rear in elevation in FIG. 1. The second is a base 24 which is secured in a manner to be described below in greater detail to the lower portion of the main body member. The third is a closure member 26 which is hinged at one side to the main body member by a suitable hinge 28. Accordingly, the closure member may be moved between an open position (FIG. 9), which gives access to the interior of the case, and a closed position (FIGS. 3 through 6). As can be seen in FIGS. 3, 5 and 6, each of the main components of the case has a double wall which results from the blow molding technique by which it is made. In particular, and as is well known in the art, a tubular parison is extruded between mating die members having mold cavities configured to the external shape of the component being formed. The die members are clamped about the depending, extruded parison and an injection needle is inserted therein. A fluid such as air under pressure is then injected into the interior of the parison to expand it into conformity with the mold cavities of the die members.

The main body section 22 is formed with an exterior roof 30 and a generally cylindrical exterior side wall 32. The interior of the main body member also has an interior roof 34 and an interior wall 36 having a large, inwardly projecting structure 38 formed with several annular, increasing diameter ledges 40 and two opposing conical sections 42 and 44 which generally conform to the exterior configuration of lantern 12 and serve to position it in the case. Inwardly projecting structure 38 and the configuration of the double walled roof 30 and 34 are most conveniently molded between mating die members which close together in the horizontal direction toward the axis A of the case as shown in FIG. 3. This mold arrangement permits the various structures, described above in detail, to be formed without reentrant portions and complex multi-part mold members.

Figure 8:
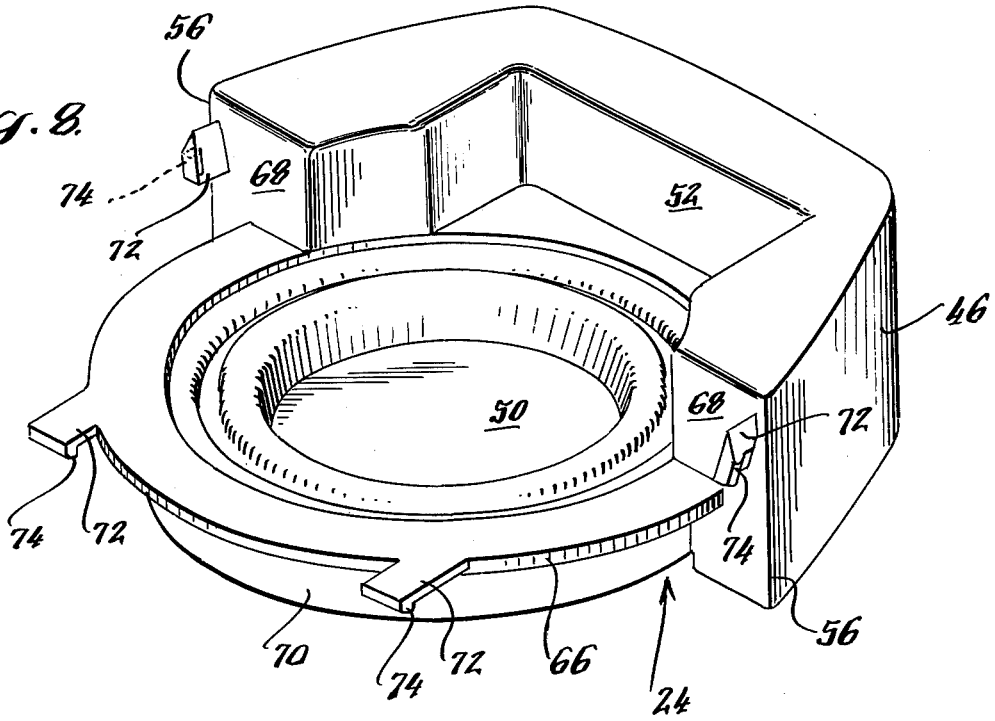
FIG. 8 is an enlarged perspective view of the base member of the molded case of the present invention.

As can be seen in detail in FIGS. 3, 6, and 8, the base member 24, which is joined at its lower end to the main body member 22, is also a double wall construction that results from formation by the blow molding process. The base member has a generally cylindrical outer wall 46 and a planar exterior bottom 48. Its interior wall is formed with a planar floor 50 and an upstanding interior wall 52 that complements a similar section 54 of the main body member 36. The floor 50 is recessed a significant distance from the top of the upstanding wall 52. The upstanding wall 52 is generally U-shaped and joined with the exterior wall 46 at junctures 56.

As can be readily appreciated from FIGS. 3 and 9, it would be extremely difficult and expensive to blow mold the structure formed by assembly of the base member 24 and main body member 22 as a single part. Molding of the reentrant portion defined by the significantly recessed floor 50, the upstanding wall of the base member, and the roof 30 and 34 of the main body member, requires extremely complicated mold members. Moreover, blow molding such configuration would result in an extremely thin walled section in the region of the complementary upstanding wall portion 54 of the main body member 22. This thin wall would result from the excessive stretching of the extruded tubular parison, when clamped in mating mold members into that region. Accordingly, the present invention forms the respective main body and base members as two components and includes effective yet simple means for securing the two together to prevent demounting of the assembly.

The mounting arrangement between the main body and base members is shown best in FIGS. 3 and 6 through 8. As can be seen there, the main body member is formed with an annular groove or rabbet 58 having opposed planar, annular bearing surfaces 60 and 62. Below the annular groove 58 and extending generally perpendicularly therefrom is a partially cylindrical bearing surface 64.

The base member 24 includes a complementary structure that interfits with the grooves and various bearing surfaces described above. This complementary structure includes an annular flange 66 which extends from the faces 68 of interior base member wall 52 adjacent to junctures 56. Beneath the flange and extending perpendicularly therefrom is a partially cylindrical wall 70. When assembled, as shown in FIG. 3, the flange 66 interfits tightly between the opposed bearing surfaces 60 and 62 of groove 58. Similarly, the cylindrical wall 70 fits tightly against the cylindrical bearing surface 64. Since all of these structures are generally circular or cylindrical in elevation, that is, they are non-colinear, great resistence against moving the base member or bending it axially away from the main body member is exerted.

The base member is held in rigid assembly with the main body member by four retaining projections or tabs shown in detail in FIG. 8. Each of these projections 72 is formed with an enlarged retaining lip 74 at its outer margin. Moreover, the projections are positioned to interfit with corresponding slots 76 (FIGS. 6 and 7) that extend from the groove 58 through the interior wall of the main body member 22. Each slot is further formed with an opposing retaining clamp 78 that locks the respective projections and integral retaining lips permanently therein, that is, against the margin 79 of the slot opposite the clamp. Therefore, once the projections are completely inserted into the appropriate slots, they may not be removed without breaking some portion of the structure. Further, as shown in FIG. 7, the lip 74 is canted slightly toward the margin 79. Accordingly, any force which tends to withdraw the projection from the slot causes the lip to bind more tightly against the projection and thus to more strongly resist removal. This tightly interlocking projection and slot arrangement combined with the annular groove and bearing surface arrangements described in detail above form a rigid assembly between the main body and base members that is as strong as an integrally formed structure.

The closure member 26 of the case described in detail above also has various features which prevent it from being easily molded with base member 24. In particular, as can be seen in FIG. 3, the closure member has an exterior roof 80 complemented by an interior roof 82. An interior wall 84 complements a smooth exterior wall 86 and is formed with an inwardly projecting structure 88. The inwardly projecting structure also includes a generally conical section 90 and several annular ledges 92 that complement opposing ledges in the main body member and firmly hold the lantern therein.

It is desirable to form the respective components of the case of the present invention in the manner described above for several reasons. First, the recessed floor of the base member prevents the lantern from easily sliding from the case even when the closure member is in its open position shown in FIG. 9. Accordingly, so long as the case is in its upright position the lantern may only be removed by being tilted and lifted upwardly and outwardly. Moreover, the deeply recessed floor 50 which is situated below an upstanding circular support 98 in the base member provides room for storage of spare parts for the lantern which may be carried beneath the lantern base.

The case of the present invention also includes certain features for the convenience of its user. As shown in FIG. 2, a latch is provided which includes a flexible plastic latch member 100 having a square aperture 102 therein. This aperture is adapted to fit over a lug 104 formed on the edge of the main body member. The latch is secured to the closure member by being snap fitted over a retaining rib 106 formed thereon. This latch may be of the type disclosed in U.S. Pat. No. 3,730,576 to the present inventor.

A handle 108 may be positioned on top of the case and attached to the main body member in a suitable enlarged lug 110. In this position, seen best in FIGS. 1 and 3, the case and any article which it carries are properly balanced.

Accordingly, it will be appreciated from the description provided above that the carrying case of the present invention provides a simple construction which affords all benefits associated with blow molded cases yet which avoids problems previously encountered in forming such articles. The respective components of the case may be easily fabricated and assembled. However, once assembled, the components are as or more structurally sound than intergrally formed components having the same formations.

Accordingly, though a specific embodiment of the molded article carrying case of the present invention has been described in detail, it is to be understood that this is for purposes of illustration. Modifications may be made to this carrying case by those skilled in the art in order to adapt it to particular applications.

What is claimed is:

1. A molded case, formed to support and enclose an article having a base, said case comprising:

A. a main body member having an interior wall shaped to generally conform to a portion of the article and having at least one inwardly projecting structure;

B. a base member formed with:

1. an upstanding interior wall that complements said interior wall of said main body member and
2. a floor recessed from said upstanding interior wall and shaped to receive the base of the article;

C. means for securing said base member to said main body member; and

D. a closure member, hinged to said main body member for movement between closed and open positions, formed with an interior wall which generally extends from said base member upstanding wall and complements said main body member interior wall when in the closed position.

2. A molded case, for supporting and enclosing an article having a base, said case comprising:

A. a main body member formed with an interior wall having:

1. an upper portion shaped with at least one inwardly projecting structure to generally conform to a portion of the article,
2. a lower portion shaped with a rabbet above the lower margin thereof;

B. a base member formed with:

1. an upstanding interior wall that at least partially complements the lower portion of the interior wall of said main body member,
2. a floor recessed from said upstanding wall and shaped to receive the base of the article, and
3. a flange shaped to interfit with said main body member rabbet;

C. means for securing said base member to said main body member with said flange interfitted with said rabbet;

D. a closure member hinged to said main body member for movement between closed and open positions, and formed with:

1. an interior wall that generally extends from said base member upstanding wall and further complements the upper portion of the interior wall of said main body member, and
2. at least one inwardly projecting structure.

3. The molded case for supporting and enclosing an article as claimed in claim 2 wherein the lower portion of the interior wall of said main body member is further shaped with a first bearing surface that is positioned below and generally perpendicular to said rabbet and wherein said base member is shaped with a second, mating bearing surface, positioned below and generally perpendicular to said flange, that abuts said first bearing surface when said base member is secured to said main body member.

4. A molded case for supporting and enclosing an article as claimed in claim 2 wherein said flange and said rabbet are non-linear in elevation.

5. The molded case for supporting and enclosing an article as claimed in claim 2 wherein said body member is formed with a roof at least a part of which projects inwardly of said case in the same direction as does said main body member inwardly projecting structure.

6. The moled case for supporting and enclosing an article as claimed in claim 2 wherein said closure member is formed with a roof at least a part of which projects inwardly of said case in the same direction as does said closure member inwardly projecting structure.

7. The molded case for supporting and enclosing an article as claimed in claim 2 wherein said securing means comprises:

1. at least one projection formed with one of said base member and main body member, and having an enlarged retaining lip adjacent its end; and
2. a number of slots corresponding to the number of projections each formed in the other of said base member and main body member for receiving said projection and said retaining flange.

8. The molded case for supporting and enclosing an article as claimed in claim 7 wherein each of said slots is bounded by a locking clamp and a margin opposing said clamp, said clamp being formed to force said retaining lip into interengagement with said margin.

9. The molded case for supporting and enclosing an article as claimed in claim 8 wherein said retaining lip is canted toward said margin to interlock therewith and resist projection withdrawal from said slot.

10. The molded case for supporting and enclosing an article as claimed in claim 2 wherein each of said main body, base, and closure members are blow molded and therefore have at least partial double wall construction.

11. The molded case for supporting and enclosing an article as claimed in claim 2 further comprising:

latch means for holding said closure member in its closed position.

12. The molded case for supporting and enclosing an article as claimed in claim 2 further comprising:

handle means formed to be grasped by a user to assist in carrying said case.

13. A molded case, for supporting and enclosing an article having a base, said case comprising:

A. a main body member formed with an interior wall having:
   1. an upper portion shaped with at least one inwardly projecting structure to generally conform to a portion of the article,
   2. a lower portion shaped with a rabbet above the lower margin thereof;

B. a base member formed with:
   1. an upstanding interior wall that at least partially complements the lower portion of the interior wall of said main body member,
   2. a floor recessed from said upstanding wall and shaped to receive the base of the article, and
   3. a flange shaped to interfit with said main body member rabbet;

C. means for securing said base member to said main body member with said flange interfitted with said rabbet.

14. The molded case for supporting and enclosing an article as claimed in claim 13 wherein the lower portion of the interior wall of said main body member is further shaped with a first bearing surface that is positioned below and generally perpendicular to said rabbet and wherein said base member is shaped with a second, mating bearing surface, positioned below and generally perpendicular to said flange, that abuts said first bearing surface when said base member is secured to said main body member.

15. A molded case for supporting and enclosing an article as claimed in claim 13 wherein said flange and said rabbet are non-linear in elevation.

16. The molded case for supporting and enclosing an article as claimed in claim 13 wherein said main body member is formed with a roof at least a part of which projects inwardly of said case in the same direction as does said main body member inwardly projecting structure.

17. The molded case for supporting and enclosing an article as claimed in claim 13 wherein said securing means comprises:

1. at least one projection formed with one of said base member and main body member, and having an enlarged retaining lip adjacent its end; and
2. a number of slots corresponding to the number of projections each formed in the other of said base member and main body member for receiving said projection and said retaining flange.

18. The molded case for supporting and enclosing an article as claimed in claim 17 wherein each of said slots is bounded by a locking clamp and a margin opposing said clamp, said clamp being formed to force said retaining lip into interengagement with said margin.

19. The molded case for supporting and enclosing an article as claimed in claim 18 wherein said retaining lip is canted toward said margin to interlock therewith and resist projection withdrawal from said slot.

20. A blow molded plastic container of double walled construction providing an inner wall, which generally conforms to the contour of an article having a base to be protectively supported in said container, thereby serving as a positioning means for the article, and an outer wall spaced from said inner wall to thereby insulate an article supported in the container against external forces striking said outer wall, said container comprising:

A. a main, partially cylindrical body member;

B. a separate base member having a fully cylindrical recessed portion which conforms generally to the base of the article to be supported therein, and C. connector means formed with said main body member and said base member for locking them together in complementary orientation with said main body member defining a partially cylindrical side wall and said base member recessed portion defining a shelf projecting in a diametric direction from said side wall.

* * * * *